United States Patent [19]

Griepentrog

[11] 4,231,226

[45] Nov. 4, 1980

[54] METHOD AND APPARATUS FOR VAPORIZING LIQUID NATURAL GASES

[75] Inventor: Hartmut Griepentrog, Oberhausen, Fed. Rep. of Germany

[73] Assignee: Maschinenfabrik Augsburg-Nürnberg Aktiengesellschaft, Fed. Rep. of Germany

[21] Appl. No.: 895,043

[22] Filed: Apr. 10, 1978

Related U.S. Application Data

[63] Continuation of Ser. No. 684,646, May 10, 1976, abandoned.

[30] Foreign Application Priority Data

May 28, 1975 [DE] Fed. Rep. of Germany ..... 2523672

[51] Int. Cl.[3] ..... F01K 17/00

[52] U.S. Cl. ..... 60/648; 62/52

[58] Field of Search ..... 60/648, 650, 651, 655, 60/671, 682, 690, 693; 62/52

[56] References Cited

U.S. PATENT DOCUMENTS

| | | | |
|---|---|---|---|
| 3,438,216 | 4/1969 | Smith | 60/671 X |
| 3,724,229 | 4/1973 | Seliber | 62/52 |
| 3,867,811 | 2/1975 | Waeselynck | 62/52 X |
| 3,878,683 | 4/1975 | Imai | 60/651 X |
| 3,932,996 | 1/1976 | Bammert et al. | 60/650 |
| 3,978,663 | 9/1976 | Mandrin et al. | 62/52 X |

*Primary Examiner*—Allen M. Ostrager
*Assistant Examiner*—Stephen F. Husar
*Attorney, Agent, or Firm*—McGlew and Tuttle

[57] ABSTRACT

Liquid natural gases are vaporized by directing them into heat exchange relationship with waste heat produced from a thermal power engine. In a closed turbine cycle system, vapor which is discharged from the turbine is passed through one or more heat exchangers and the natural gas is moved through the heat exchanger in heat exchange relationship with the vapor to effectively cool the vapor as well as to evaporate the natural gases which are supplied in a liquid form, for example.

2 Claims, 11 Drawing Figures

METHOD AND APPARATUS FOR VAPORIZING LIQUID NATURAL GASES

This is a continuation, of application Ser. No. 684,646 filed May 10, 1976, now abandoned.

FIELD AND BACKGROUND OF THE INVENTION

This invention relates in general to devices for vaporizing liquefied natural gases, and in particular to a new and useful method and apparatus for vaporizing liquefied natural gases by utilizing only, or partially, the waste heat of closed cycle thermal power engines.

DESCRIPTION OF THE PRIOR ART

It is well known to vaporize the liquefied natural gas stored in a landed tank ship prior to feeding it into the existing pipeline systems. In the prior art, sea water or fire tube emergent evaporators are used for this purpose to produce the evaporation heat. Both methods have the disadvantage of requiring additional energy for producing the heat necessary for the evaporation. This means high cost of energy production. Therefore there was a problem of providing a method and a device for carrying out the method which permits the supply of energy without spending a separate amount for the production of the energy to do this. One known method of vaporizing and superheating a cryogenic medium employs the waste gases of a gas turbine for the heat exchange. Here, however, the utilization of energy is limited to the process of gasifying the liquid natural gas. The actual output of the gas turbine supplying the waste gas of course is not increased by this manner of heat exchange.

SUMMARY OF THE INVENTION

In accordance with the invention, it is made possible to utilize the heat of a power engine in the vaporization of liquefied natural gases in such a way that the operating efficiency of the power engine is increased, and without interfering with its operation. This is not possible by a mere utilization of the waste gases; that is why, prior to the present invention, the problem seemed unsolvable. Surprisingly, however, it has been found that this combination of problems can be solved by providing, in accordance with the invention, that the waste heat as a vaporization heat is supplied by way of optimizing the complete cycle of operation of a closed cycle thermal power engine which has either a single or a multiple circuit arrangement.

According to a development of the invention, the waste heat of thermal power engines with a closed cycle operation is taken from the circulating engine operating fluid and transferred in one or more heat exchangers to the liquefied natural gases, in which the circulating operating fluid is subjected at least once during the compression to an intermediate cooling.

Further according to the invention, additional evaporation heat for the natural gas is supplied, for example, through sea water, heated evaporators, flue gases of heaters or steam boilers, and wherein the steam boiler itself provides an integral part of the heater.

For oxygen-containing circulating operating fluids, it is advantageous in accordance with the invention to use an intermediate circuit having a higher pressure as compared to the pressure of the gas circulating in the fore cooler or the intermediate cooler.

Another possibility in accordance with the invention is to vaporize the liquefied natural gas directly in the gas heater.

In all cases in accordance with the invention, the circulating engine operating fluid may comprise air, helium, neon, argon or nitrogen.

A device system for carrying out the inventive method of vaporizing liquefied natural gases is designed so that the lines conveying the liquefied natural gas to be vaporized are associated with at least three heat exchangers which, in turn, are incorporated in the closed circuit of operation of the thermal power engine, and wherein the system includes a further after-heating.

The technological effect of the invention is clear; the liquefied natural gas is gasified by energy which is of no particular importance; the waste heat is utilized. This utilization of the waste heat is carried out in such a way that the efficiency of the thermal power engine in the closed circuit is increased. This is because, as is well known, the efficiency of a thermal power engine depends on the ratio of the maximum to the minimum temperature of the working process. Since the contacting liquefied natural gas applied to two of the heat exchangers has a temperature of about −150° C., the working processes of such combined power units are optimized within the practicable range. In such cases the high thermal efficiency of about 70% is attained. The circulating operating fluid, of course, must meet the easily observable conditions of being still gaseous or, at least, still liquid at the very low temperatures and of not dissociating in the high temperature range. For designing a gas turbine with a maximum efficiency, at least one simple intermediate cooling is necessary. This, however, lowers the temperature of the waste heat down to a level which is too low for maintaining the temperature of the natural gas during the feeding into the pipeline at the desired temperature of about 15° C. Therefore, in accordance with the invention, means for additional heating are also provided.

Accordingly it is an object of the invention to provide a method of vaporizing liquefied natural gases by heat supply while utilizing either alone, or in addition, the waste heat of a thermal power engine wherein the waste heat is supplied by reducing the operating temperature range of the power engine by the cooling of the circulating engine operating medium in either a single thermal power engine circuit or a multiple thermal power engine circuit.

A further object of the invention is to provide a device for vaporizing liquefied natural gases which includes a power engine having at least three heat exchangers for reducing the temperature of the circulating medium in a closed cycle and means for circulating liquefied natural gases in heat exchange relationship with the medium in two of the heat exchangers.

A further object of the invention is to provide an apparatus for vaporizing liquefied natural gas which is simple in design, rugged in construction and economical to manufacture.

For an understanding of the principles of the invention, reference is made to the following description of typical embodiments thereof as illustrated in the accompanying drawings.

GENERAL DESCRIPTION OF THE PREFERRED EMBODIMENTS

Figure 1A:
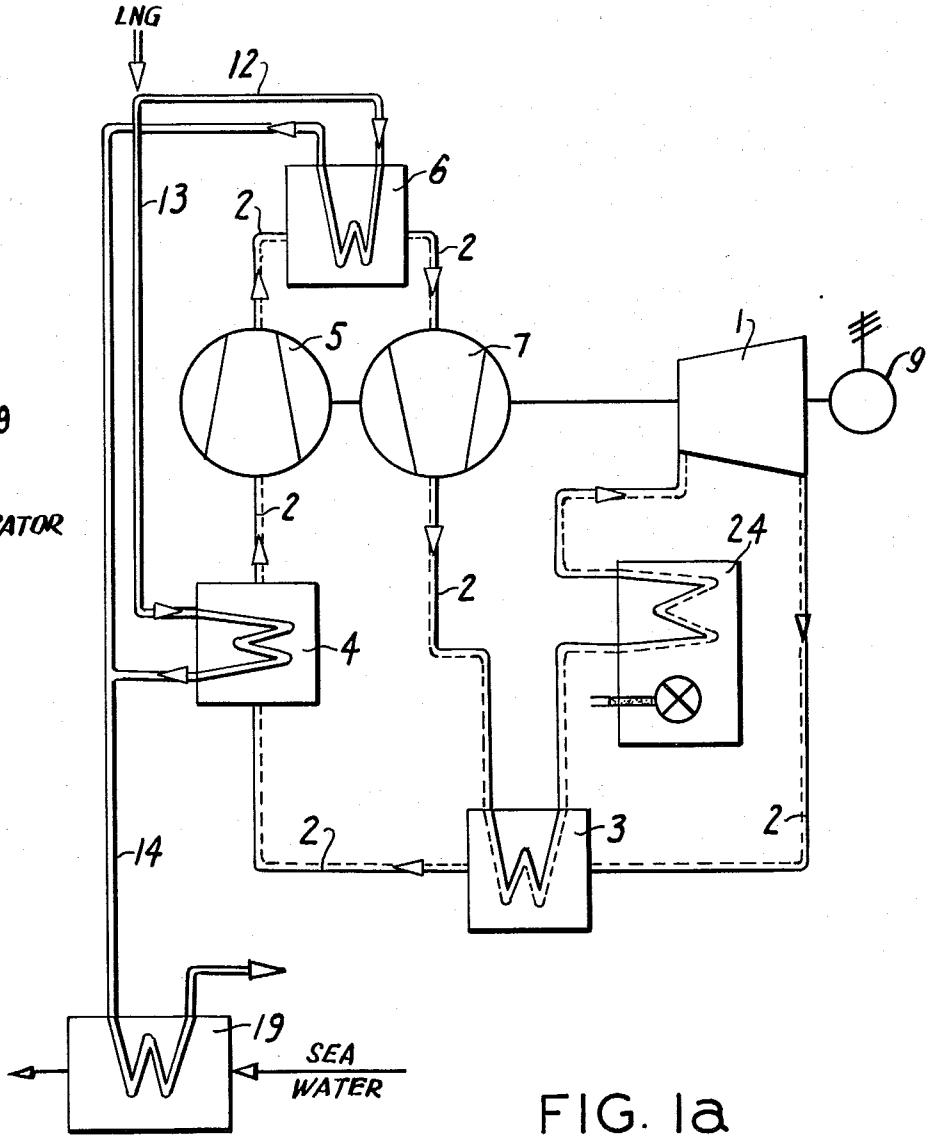
FIG. 1*a* is a view similar to FIG. 1 of another embodiment of the invention having a separate supply of external heat.

Referring to the drawings, and all of the figures include similar parts of a power engine cycle which are similarly designated throughout the various figures. As shown in FIG. 1, a turbine 1 has a shaft 10 connected to a generator 9, a high pressure compressor 7 and a low pressure compressor 5. The numeral 2 is used to indicate the connecting pipes of the closed power cycle of the turbine cycle. The operating medium or fluid is passed through a heater or boiler 8 and circulated to the turbine and thence through several heat exchangers 3, 4 and 6 and the compressors 5 and 7.

In accordance with the invention, liquefied natural gas is delivered through a supply line 11 to one or more branching lines 12, 13 and is circulated into individual heat exchangers 6 and 4 as shown in FIG. 1. During this process the liquefied natural gas is vaporized and the cycle efficiency of the turbine is increased.

The engine operating medium leaving high pressure compressor 7 passes through the heat exchanger 3 where it is heated by the engine operating fluid discharged from the turbine exhaust, so that the operating fluid is thus preheated before entering the heater or boiler 8.

Figure 1:
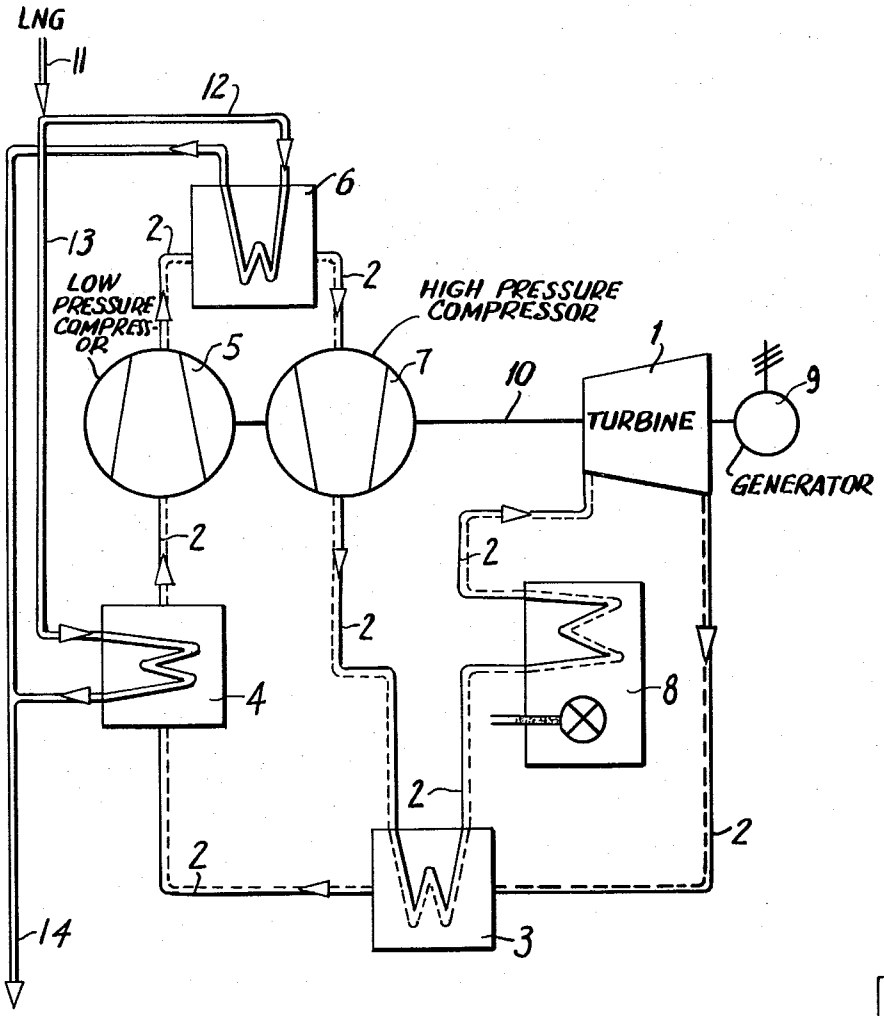
FIG. 1 is a schematic view of a power turbine engine in a closed cycle having at least three heat exchangers for the cooling of the circulating medium to increase the efficiency of the power cycle, and which includes means for circulating liquefied natural gas into heat exchange relationship with the circulated medium constructed in accordance with the invention.

FIG. 1*a* is substantially identical to FIG. 1 but also includes a heat exchanger 19 through which sea water is directed in order to provide a further heating of the liquefied natural gas and its evaporation by the sea water which comprises a higher temperature medium.

Figure 1C:
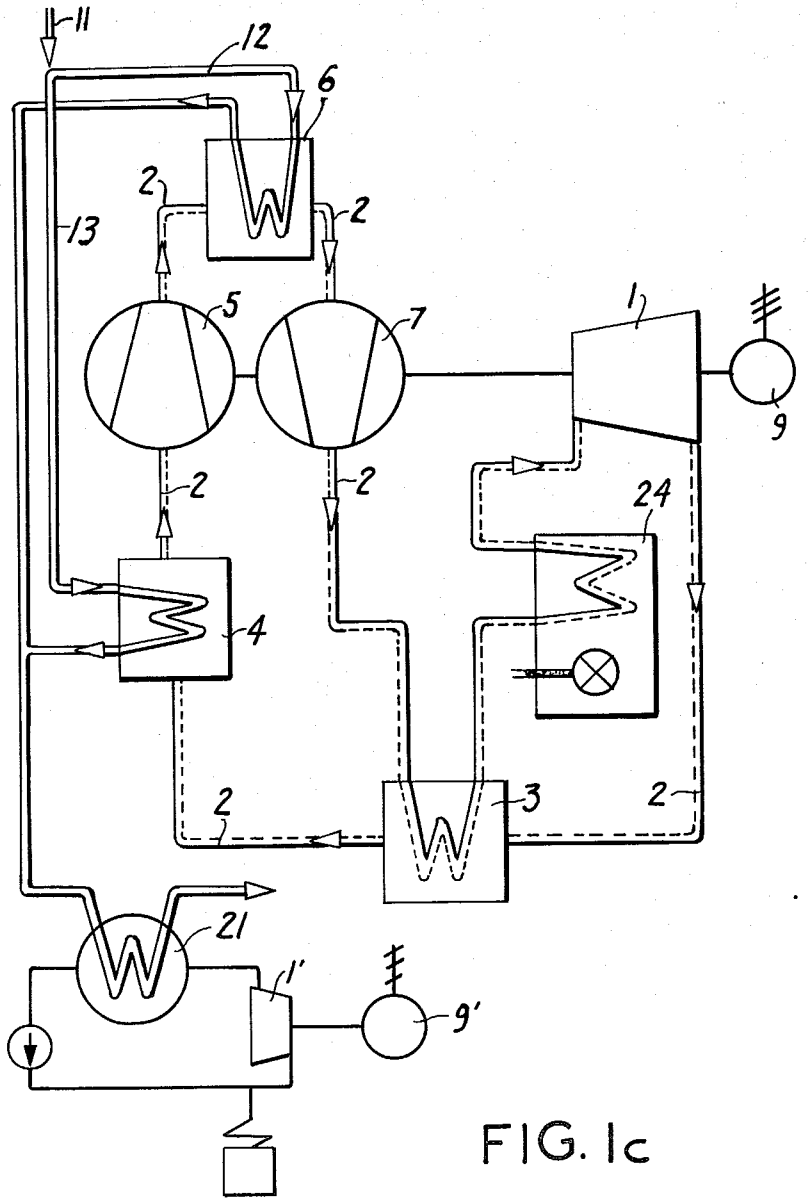
FIG. 1*c* is a view similar to FIG. 1 of still another embodiment of the invention, which includes an additional steam turbine for supplying external heat.
Figure 1B:
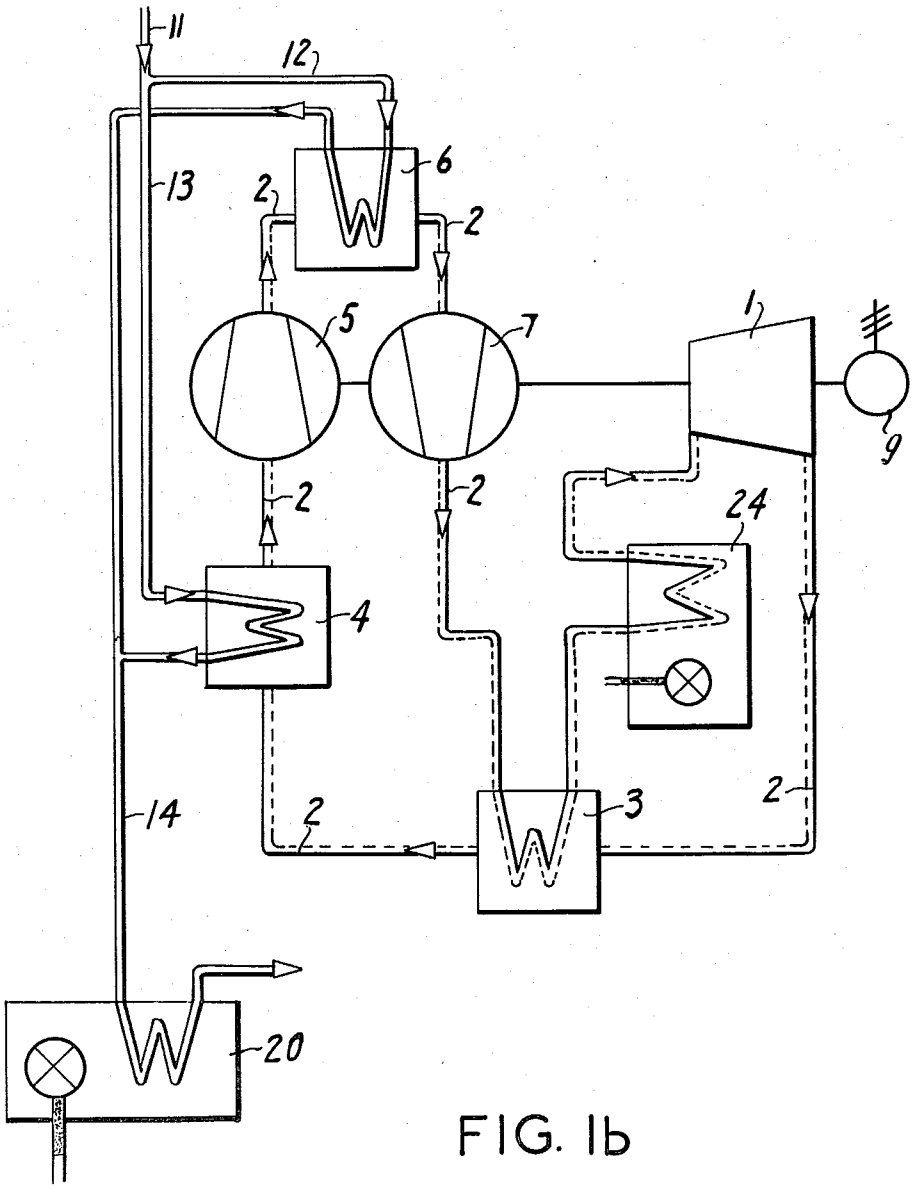
FIG. 1*b* is a view similar to FIG. 1 of another embodiment of the invention, which includes an evaporator.

In the FIG. 1*b* embodiment an after-burner or heater 20 is provided in the line 14.

In FIG. 1*c* the line 14 includes an after-heater 21, which is associated with a second turbine 1'.

Figure 2:
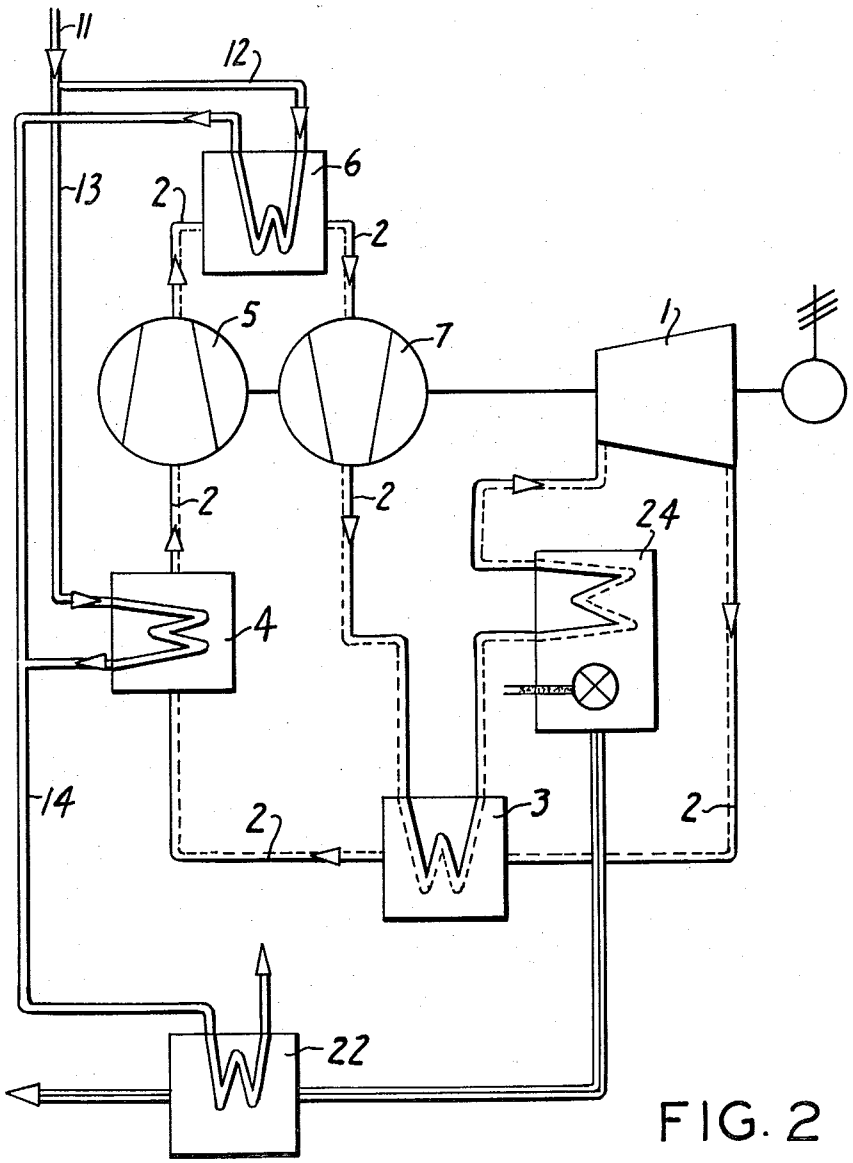
FIG. 2 is a view similar to FIG. 1 of still another embodiment of the invention, in which the stack gas of a heater, steam boiler or evaporator is employed.

In the FIG. 2 embodiment an after-heater 22 is located in the line 14, and heating gases are supplied to this unit, for example, from a gas heater 24, which is employed in the original turbine cycle.

Figure 3:
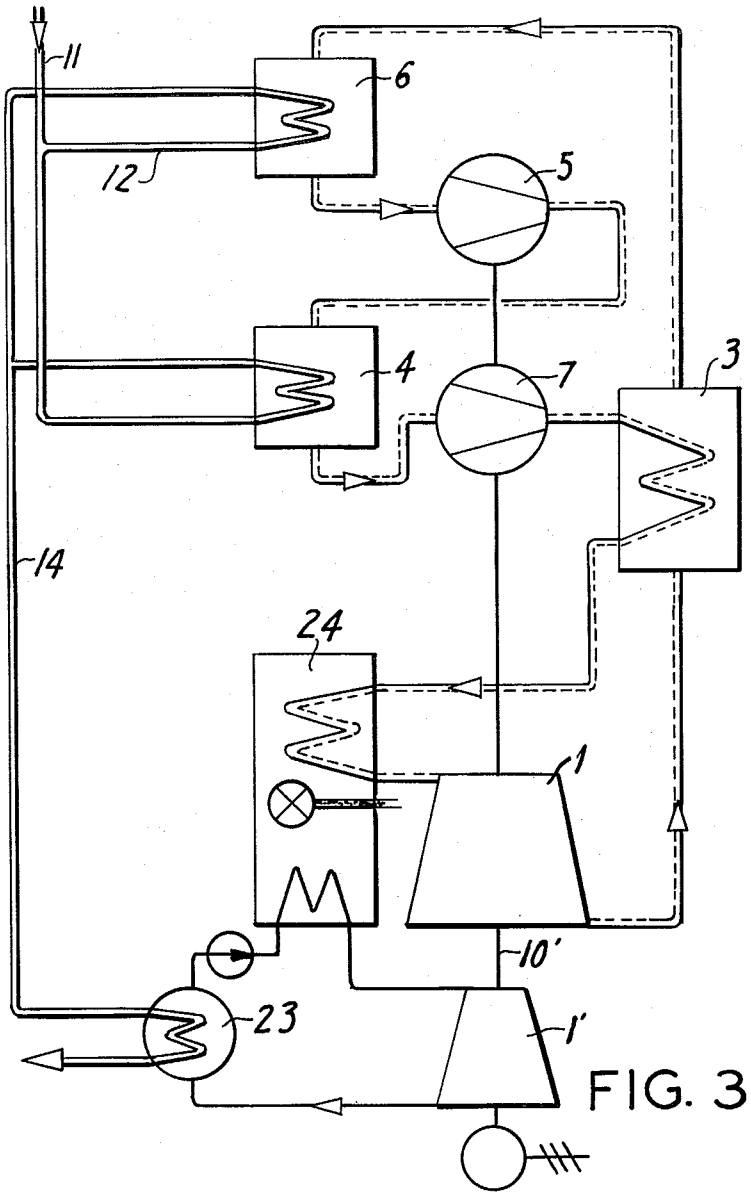
FIG. 3 is a view similar to FIG. 1 of still another embodiment of the invention.

FIG. 3 shows an arrangement wherein turbine 1' is arranged to drive turbine 1 through a shaft 10'. In this embodiment vaporized gas discharge line 14 is directed through a heat exchanger 23 which may, for example, be a condenser for condensing the exhaust steam discharged from turbine 1' whose entering steam is heated by the steam boiler 24 forming an integral part of the closed circuit associated with turbine 1.

Figure 4:
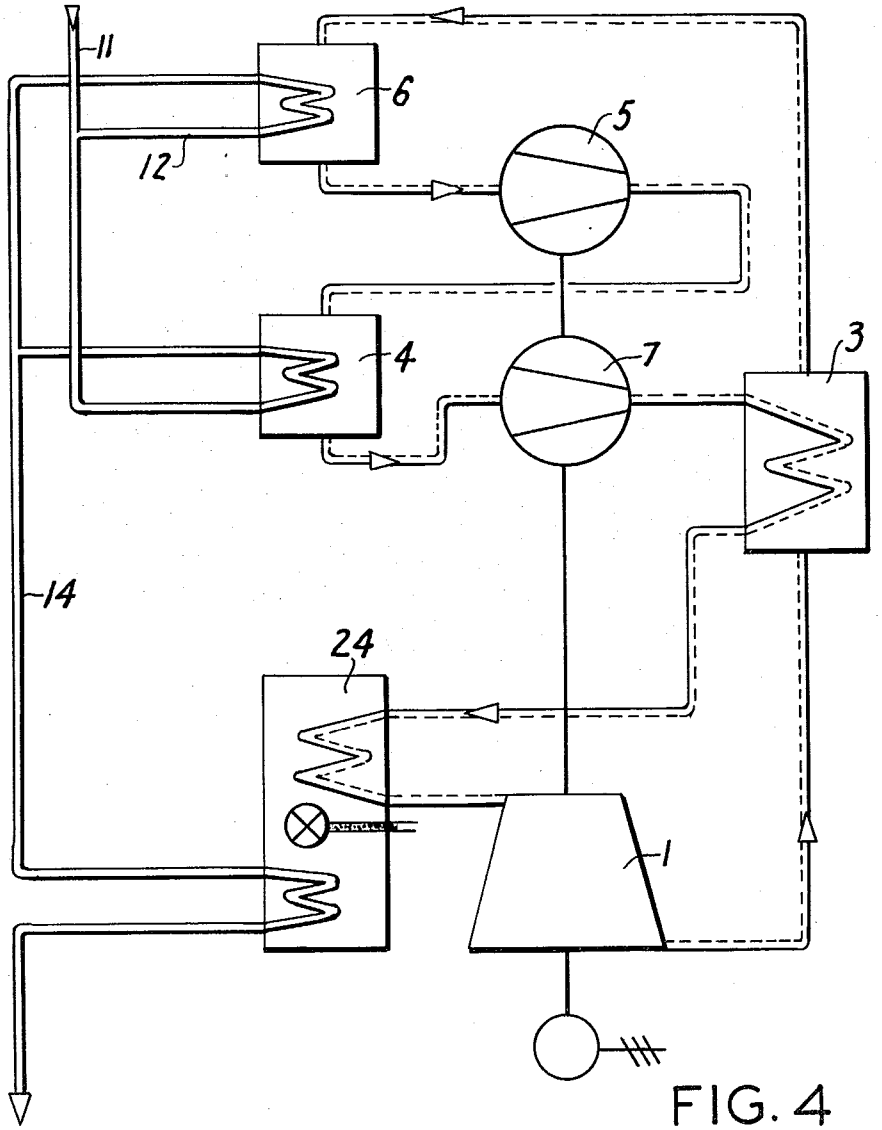
FIG. 4 is a view similar to FIG. 1 of another embodiment of the invention.

The FIG. 4 embodiment shows an arrangement where the liquefied gas is further vaporized or superheated directly in the gas heater 24.

Figure 5A:
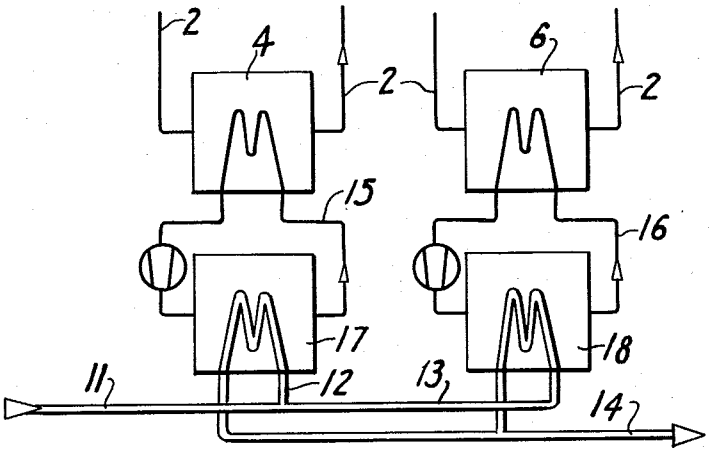
FIGS. 5*a* and 5*b* are partial views similar to FIG. 1 of still another embodiment of the invention.
Figure 5B:
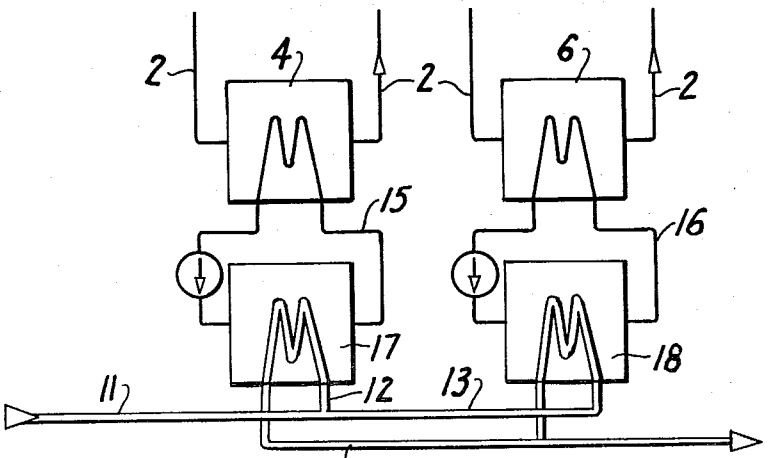

FIGS. 5*a* and 5*b* indicate systems wherein the circulating operating fluids contain oxygen and an intermediate circuit is used to separate the oxygen containing fluid from the ordinary a liquefied natural gas which is being circulated. For this purpose, after-coolers 17 and 18 are arranged through which the gas is circulated in a separate independent medium that is circulated between the after-coolers 17 and 18 through circulating lines 15 and 16 associated with heat exchangers 4 and 6.

Figure 6A:
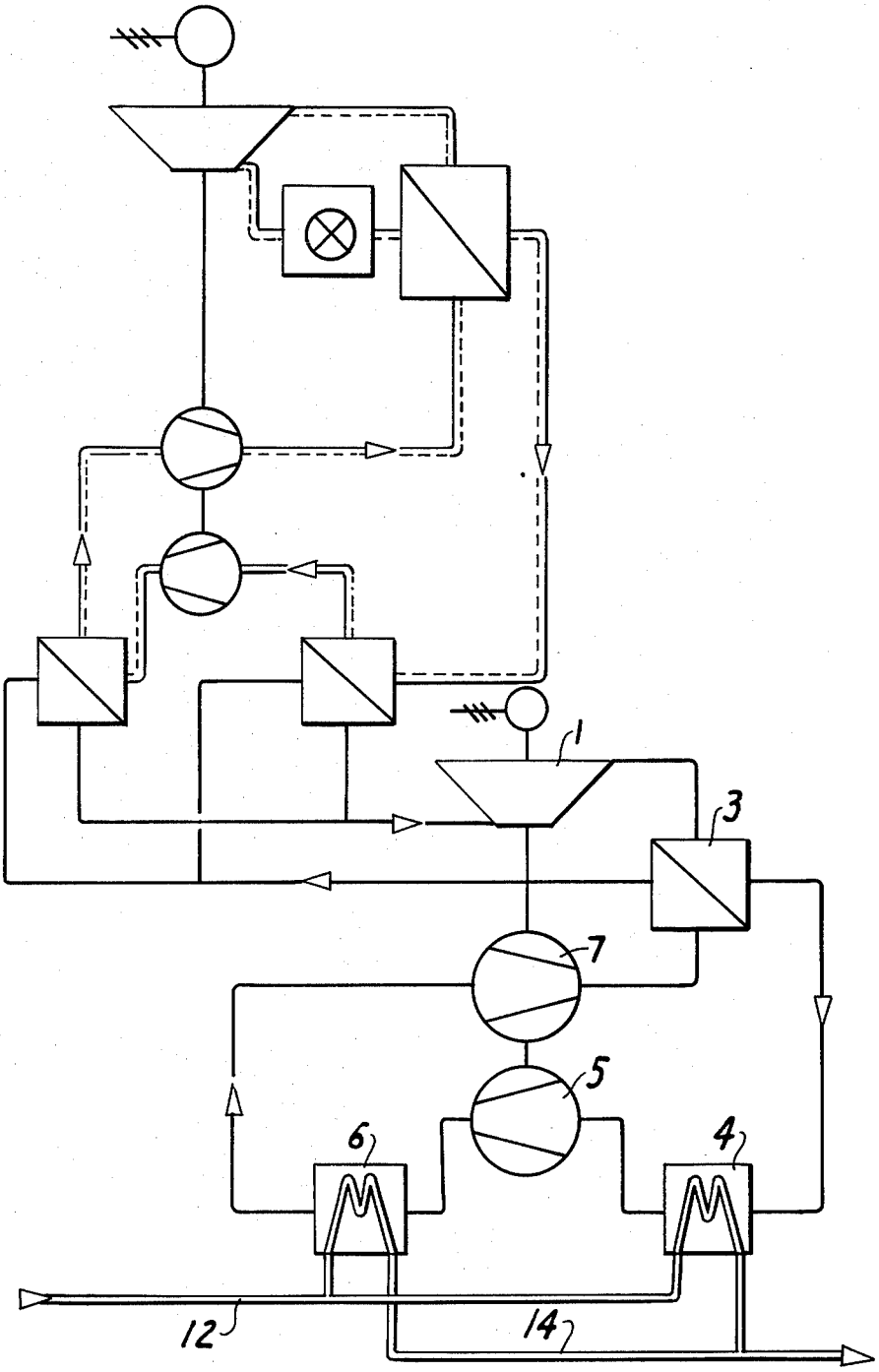
FIGS. 6*a* and 6*b* are views similar to FIG. 1 of still another embodiment of the invention.
Figure 6B:
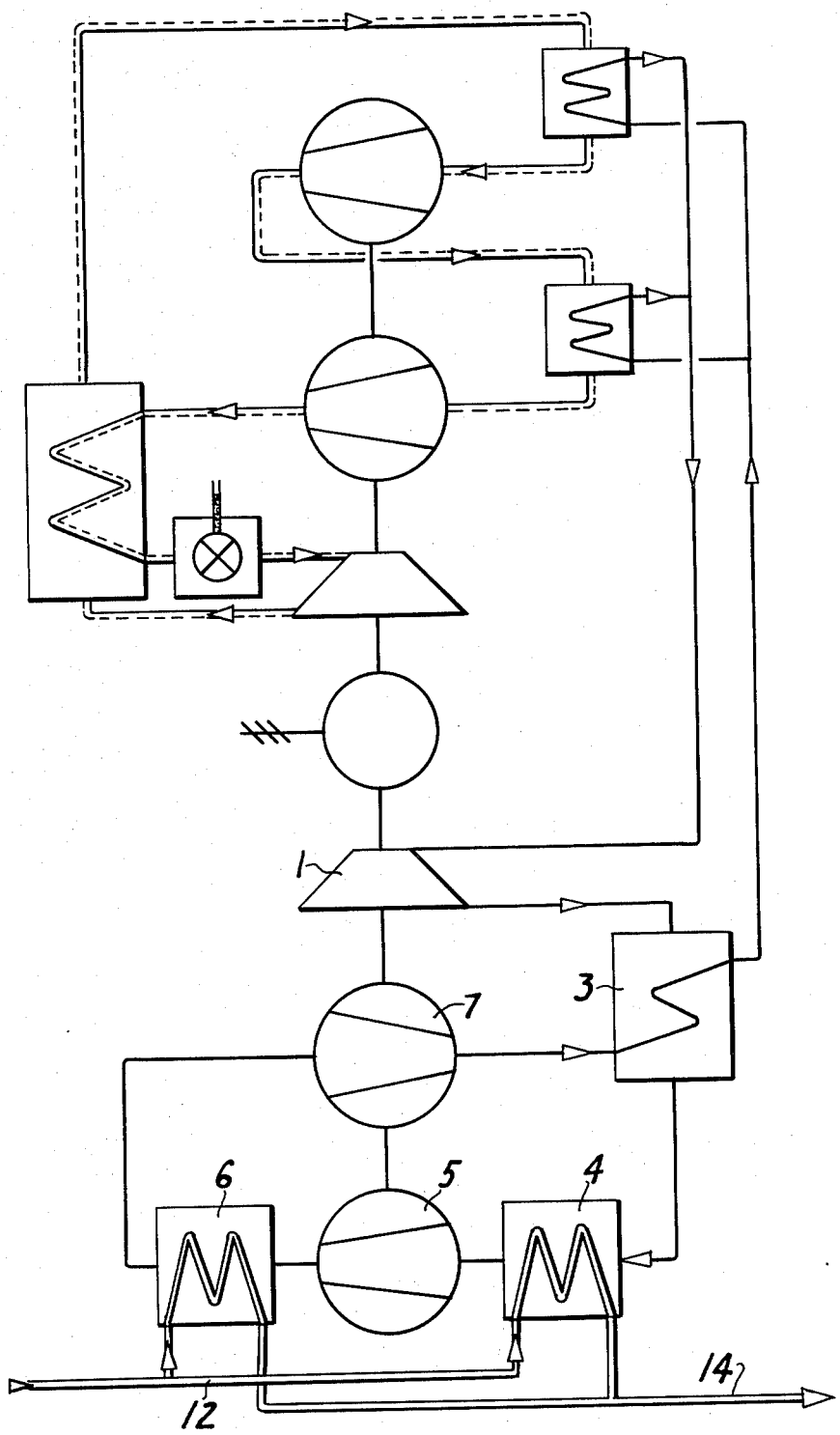

In the embodiments of FIGS. 6*a* and 6*b* there are indicated circuits in which the circulating fluid is subjected to intermediate cooling at least once during its compression.

While specific embodiments of the invention have been shown and described in detail to illustrate the application of the principles of the invention, it will be understood that the invention may be embodied otherwise without departing from such principles.

What is claimed is:

1. A system for increasing the thermal efficiency of a closed-circuit engine operated by heated operating fluid circulating in the closed circuit and for vaporizing liquefied natural gas and heating the vaporized gas to a delivery temperature suitable for delivery of the gas to a gas pipeline network, said device comprising, in combination:

said closed circuit comprising a turbine having a heated operating fluid supply inlet and an operating fluid exhaust outlet; a low pressure compressor in said closed circuit; a high pressure compressor in said closed circuit; an operating fluid heater having a heated operating fluid discharge connected to said fluid supply inlet of said turbine to drive said turbine, a first connecting line connecting said turbine exhaust outlet to the inlet of said first low pressure compressor, a second connecting line connecting the outlet of said first low pressure compressor to the inlet of said second high pressure compressor, and a third connecting line connecting the outlet of said second high pressure compressor to the inlet of said operating fluid heater;

driving means connecting said turbine to said compressors to drive said compressors;

a first heat exchanger connected to said first connecting line and in said third connecting line for preheating, by means of operating fluid discharged from said turbine exhaust outlet, the compressed operating fluid entering said operating fluid heater from said second high pressure compressor;

a second heat exchanger in said first connecting line between said first heat exchanger and said first low pressure compressor to receive the operating fluid from the first heat exchanger at a temperature greater than 15° C.;

at least a third heat exchanger in said second connecting line between said first and second compressors;

a liquefied natural gas supply line;

natural gas connection means connected to said supply line and dividing the supplied liquefied natural gas into first and second portions connected, respectively, to said second and third heat exchangers to receive heat from the operating fluid flowing through said second and third heat exchangers for vaporizing of the liquefied natural gas and heating of the vaporized gas by said operating fluid flowing through said first and second connecting lines of said closed circuit with resultant substantial cooling, by said liquefied natural gas, of said operating fluid entering said first and second compressors;

a natural gas discharge line connected to both of said second and third heat exchangers to receive at least partially vaporized natural gas therefrom; and after-heater means operatively associated with said natural gas discharge line for further heating the natural gas flowing through said natural gas discharge line to such delivery temperature, said after-heater means comprising, a fourth heat exchanger, a second turbine, and a second closed circuit carrying a fluid operating medium for said second turbine, said second closed circuit comprising said second turbine, said fourth heat exchanger, and heat exchange means associated with said operating fluid heater to receive heat from said heater, said fourth heat exchanger comprising a heat transfer line connected in series with said natural gas discharge line to transfer heat from said operating fluid medium to said natural gas.

2. A system according to claim 1, in which said driving means is connected to said second turbine.

* * * * *